US009976570B2

(12) United States Patent
Hino et al.

(10) Patent No.: US 9,976,570 B2
(45) Date of Patent: May 22, 2018

(54) BLOWER APPARATUS

(71) Applicant: Nidec Corporation, Kyoto (JP)

(72) Inventors: Yuko Hino, Kyoto (JP); Seung-Sin Yoo, Kyoto (JP); Tomoyuki Tsukamoto, Kyoto (JP); Akihiko Makita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days. days.

(21) Appl. No.: 15/608,446

(22) Filed: May 30, 2017

(65) Prior Publication Data

US 2017/0356461 A1 Dec. 14, 2017

Related U.S. Application Data

(60) Provisional application No. 62/347,380, filed on Jun. 8, 2016.

(30) Foreign Application Priority Data

Mar. 15, 2017 (JP) ..... 2017-049384

(51) Int. Cl.
*F04D 29/62* (2006.01)
*F04B 35/04* (2006.01)
(Continued)

(52) U.S. Cl.
CPC ..... *F04D 29/626* (2013.01); *F04B 17/03* (2013.01); *F04B 35/04* (2013.01); *F04D 25/06* (2013.01); *F04D 29/083* (2013.01); *F04B 17/00* (2013.01)

(58) Field of Classification Search
CPC ..... F04D 29/626; F04D 25/06; F04D 29/083; F04B 17/03; F04B 17/00; F04B 35/04; F26B 3/00; F26B 3/05; F26B 21/00
(Continued)

(56) References Cited

U.S. PATENT DOCUMENTS 4,949,477 A * 8/1990 Geiger ..... D06F 58/02 34/140
5,598,641 A * 2/1997 Kishi ..... E03D 5/00 110/238
(Continued)

FOREIGN PATENT DOCUMENTS

JP 2003014275 A * 1/2003
JP 2008-88985 A 4/2008
(Continued)

OTHER PUBLICATIONS

Related co-pending U.S. Appl. No. 15/608,270, filed May 30, 2017 counterpart Japanese Patent Application No. 2017-049380.
(Continued)

*Primary Examiner* — Stephen M Gravini
(74) *Attorney, Agent, or Firm* — Westerman, Hattori, Daniels & Adrian, LLP

(57) ABSTRACT

This blower apparatus includes an air blowing portion, a motor portion, and a housing. The housing includes an air inlet and an air outlet. At least one of the flat plates includes an air hole. Once the air blowing portion starts rotating, an air flow traveling radially outward is generated between the flat plates by viscous drag of surfaces of the flat plates and a centrifugal force. Since the air flow is generated between the flat plates, the air flow does not easily leak upwardly or downwardly, and thus, an improvement in air blowing efficiency is achieved. Since the air hole is defined in the flat plate(s), gas can be easily supplied to the axial gap, resulting in improved air blowing efficiency. In addition, with each spacer being arranged between the flat plates, the axial gap can be adjusted to have a desired axial dimension.

11 Claims, 8 Drawing Sheets

(51) Int. Cl.

| | |
|---|---|
| ***F04D 25/06*** | (2006.01) |
| ***F04D 29/08*** | (2006.01) |
| ***F04B 17/03*** | (2006.01) |
| *F04B 17/00* | (2006.01) |

(58) Field of Classification Search
USPC ..... 34/463
See application file for complete search history.

(56) References Cited

U.S. PATENT DOCUMENTS

| | | | | |
|---|---|---|---|---|
| 6,920,704 | B1 * | 7/2005 | Silverbrook | B41J 11/002 101/483 |
| 6,944,970 | B2 * | 9/2005 | Silverbrook | B41J 11/002 101/389.1 |
| 7,210,903 | B2 * | 5/2007 | Lyons | F04D 29/422 415/204 |
| 8,490,293 | B2 * | 7/2013 | Vilhunen | E04B 1/7092 34/117 |
| 2017/0356455 | A1 * | 12/2017 | Hino | F04D 17/161 |
| 2017/0356458 | A1 * | 12/2017 | Hino | F04B 35/04 |
| 2017/0356459 | A1 * | 12/2017 | Hino | F04B 35/04 |
| 2017/0356460 | A1 * | 12/2017 | Hino | F04D 17/161 |
| 2017/0356461 | A1 * | 12/2017 | Hino | F04B 35/04 |
| 2017/0356462 | A1 * | 12/2017 | Hino | F04B 35/04 |
| 2017/0356463 | A1 * | 12/2017 | Hino | F04D 17/161 |
| 2017/0356464 | A1 * | 12/2017 | Hino | F04D 29/626 |
| 2017/0356465 | A1 * | 12/2017 | Hino | F04B 35/04 |
| 2017/0356466 | A1 * | 12/2017 | Hino | F04D 29/626 |
| 2017/0356467 | A1 * | 12/2017 | Hino | F04B 35/04 |

FOREIGN PATENT DOCUMENTS

| | | | | |
|---|---|---|---|---|
| JP | 2012180942 | A * | 9/2012 | |
| KR | 101599598 | B1 * | 3/2016 | |
| WO | WO 2014208831 | A1 * | 12/2014 | F02M 35/164 |
| WO | WO 2016104872 | A1 * | 6/2016 | F24F 7/06 |

OTHER PUBLICATIONS

Related co-pending U.S. Appl. No. 15/608,321, filed May 30, 2017, counterpart Japanese Patent Application No. 2017-049381.
Related co-pending U.S. Appl. No. 15/615,115, filed Jun. 6, 2017, counterpart Japanese Patent Application No. 2017-049382.
Related co-pending U.S. Appl. No. 15/608,366, filed May 30, 2017, counterpart Japanese Patent Application No. 2017-049383.
Related co-pending U.S. Appl. No. 15/608,482, filed May 30, 2017, counterpart Japanese Patent Application No. 2017-049385.
Related co-pending U.S. Appl. No. 15/615,143, filed Jun. 6, 2017, counterpart Japanese Patent Application No. 2017-049386.
Related co-pending U.S. Appl. No. 15/615,202, filed Jun. 6, 2017, counterpart Japanese Patent Application No. 2017-049387.
Related co-pending U.S. Appl. No. 15/615,234, filed Jun. 6, 2017, counterpart Japanese Patent Application No. 2017-049388.
Related co-pending U.S. Appl. No. 15/615,279, filed Jun. 6, 2017, counterpart Japanese Patent Application No. 2017-049389.
Related co-pending U.S. Appl. No. 15/615,316, filed Jun. 6, 2017, counterpart Japanese Patent Application No. 2017-049390.

* cited by examiner

BLOWER APPARATUS

BACKGROUND OF THE INVENTION

1. Field of the Invention

The present invention relates to a blower apparatus.

2. Description of the Related Art

A centrifugal blower apparatus which generates an air flow traveling radially outward by rotating an impeller including a plurality of blades is known. A known blower apparatus including an impeller is described in, for example, JP-A 2008-88985.

In the blower apparatus described in JP-A 2008-88985, a plurality of blades referred to as fan blades push surrounding gas to generate air flows traveling radially outward.

SUMMARY OF THE INVENTION

In recent years, there has still been a demand for reductions in the size and thickness of electronic devices. Accordingly, there has also been a demand for a reduction in the thickness of blower apparatuses used to cool the interiors of the electronic devices.

Here, in the case where an impeller is used to generate air flows, as in the blower apparatus described in JP-A 2008-88985, air flows pushed by a blade leak from axially upper and lower ends of the blade while the impeller is rotating. As a result, air pressure is lower at the axially upper and lower ends of the blade than in the vicinity of an axial middle of the blade. Accordingly, a reduction in the thickness of the blower apparatus, which involves a reduction in the axial dimension of the impeller, will result in a failure to secure sufficient air blowing efficiency.

An object of the present invention is to provide a technique for realizing a centrifugal blower apparatus which is excellent in air blowing efficiency.

A blower apparatus according to a preferred embodiment of the present invention includes an air blowing portion arranged to rotate about a central axis extending in a vertical direction; a motor portion arranged to rotate the air blowing portion; and a housing arranged to house the air blowing portion and the motor portion. The housing includes an air inlet arranged above the air blowing portion, and arranged to pass through a portion of the housing in an axial direction; and an air outlet arranged to face in a radial direction at at least one circumferential position radially outside of the air blowing portion. The air blowing portion includes a plurality of flat plates arranged in the axial direction with an axial gap defined between adjacent ones of the flat plates; and a plurality of spacers each of which is arranged in a region in the axial gap between axially adjacent ones of the flat plates, the region covering a portion of a radial extent of the axial gap. At least one of the flat plates includes an air hole arranged to pass therethrough in the axial direction. Each air hole is arranged to be in communication with a space radially outside of the air blowing portion through the axial gap.

According to the above preferred embodiment of the present invention, once the air blowing portion starts rotating, an air flow traveling radially outward is generated in the axial gap between the adjacent ones of the flat plates by viscous drag of surfaces of the flat plates and a centrifugal force. Since the air flow is generated between the flat plates, the air flow does not easily leak upwardly or downwardly, and thus, an improvement in air blowing efficiency is achieved. Accordingly, a reduced thickness of the blower apparatus according to the above preferred embodiment of the present invention does not result in a significant reduction in the air blowing efficiency. Since the air hole is defined in the flat plate(s), gas can be easily supplied to the axial gap. This leads to improved air blowing efficiency. Further, with the spacers being arranged between the flat plates, each axial gap can be adjusted to have a desired axial dimension. This allows desired air blowing performance to be easily achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, blower apparatuses according to preferred embodiments of the present invention will be described. It is assumed herein that a side on which an upper plate portion is arranged with respect to a lower plate portion is an upper side, and the shape of each member or portion and relative positions of different members or portions will be described based on the above assumption. It should be noted, however, that the above definition of the upper and lower sides is not meant to restrict in any way the orientation of a blower apparatus according to any preferred embodiment of the present invention at the time of manufacture or when in use.

1. First Preferred Embodiment

Figure 1:
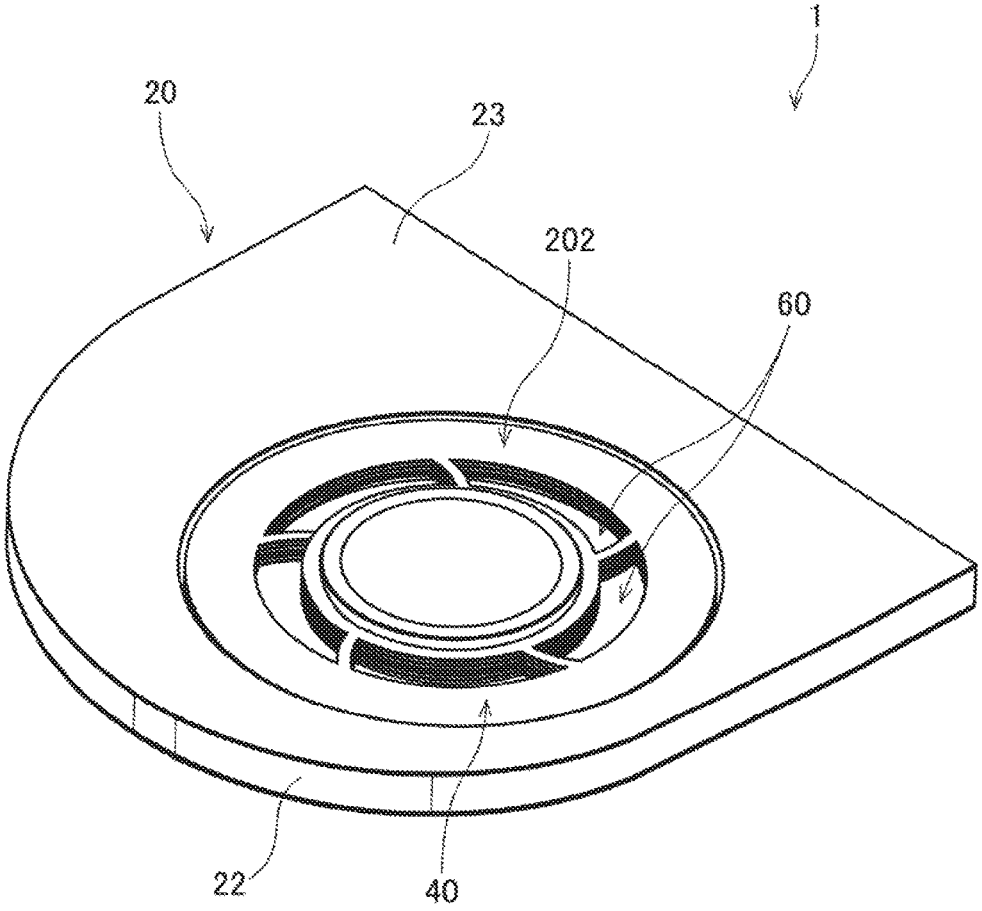
FIG. 1 is a perspective view of a blower apparatus according to a first preferred embodiment of the present invention.
Figure 2:
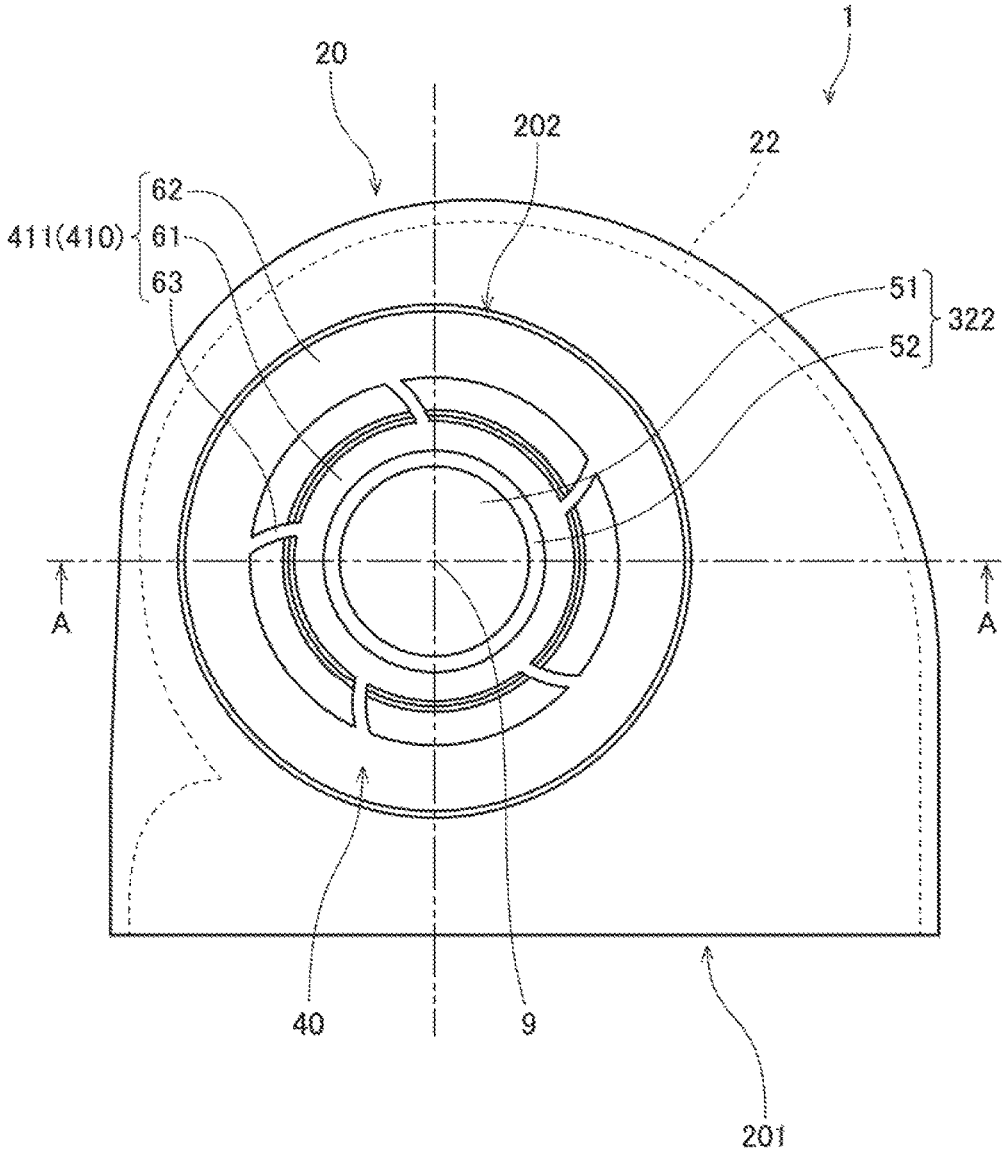
FIG. 2 is a top view of the blower apparatus according to the first preferred embodiment.
Figure 3:
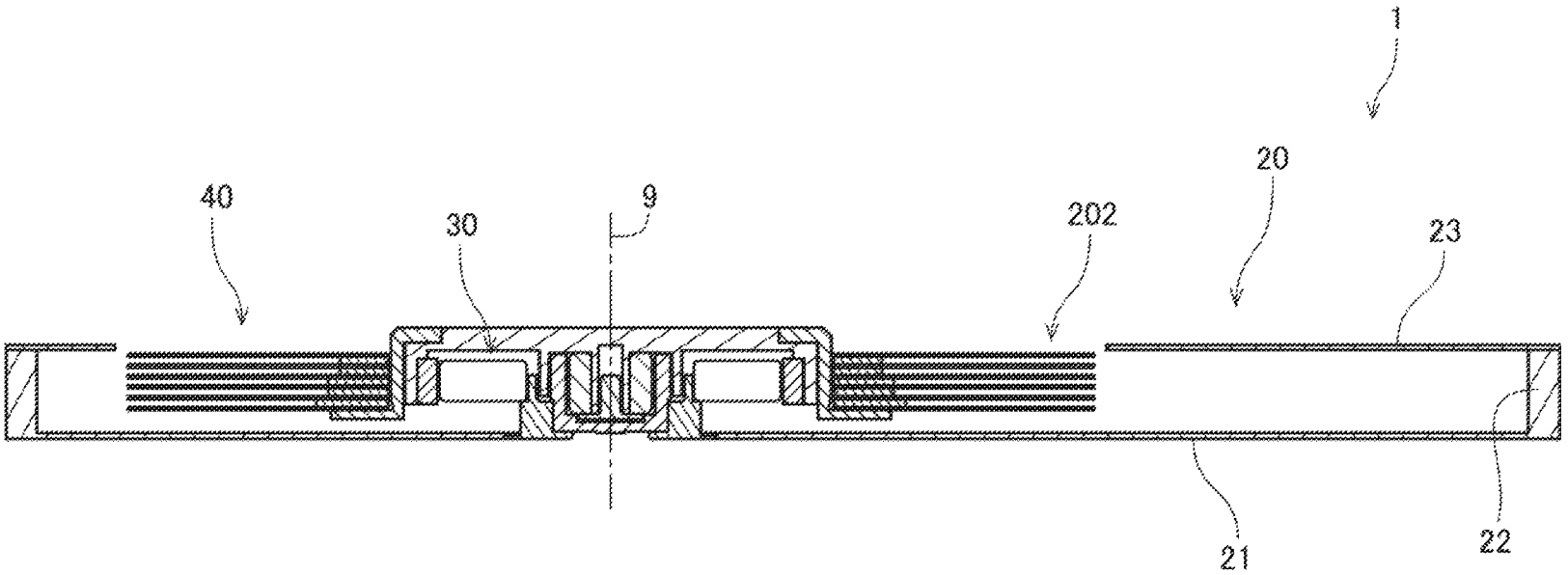
FIG. 3 is a sectional view of the blower apparatus according to the first preferred embodiment.
Figure 4:
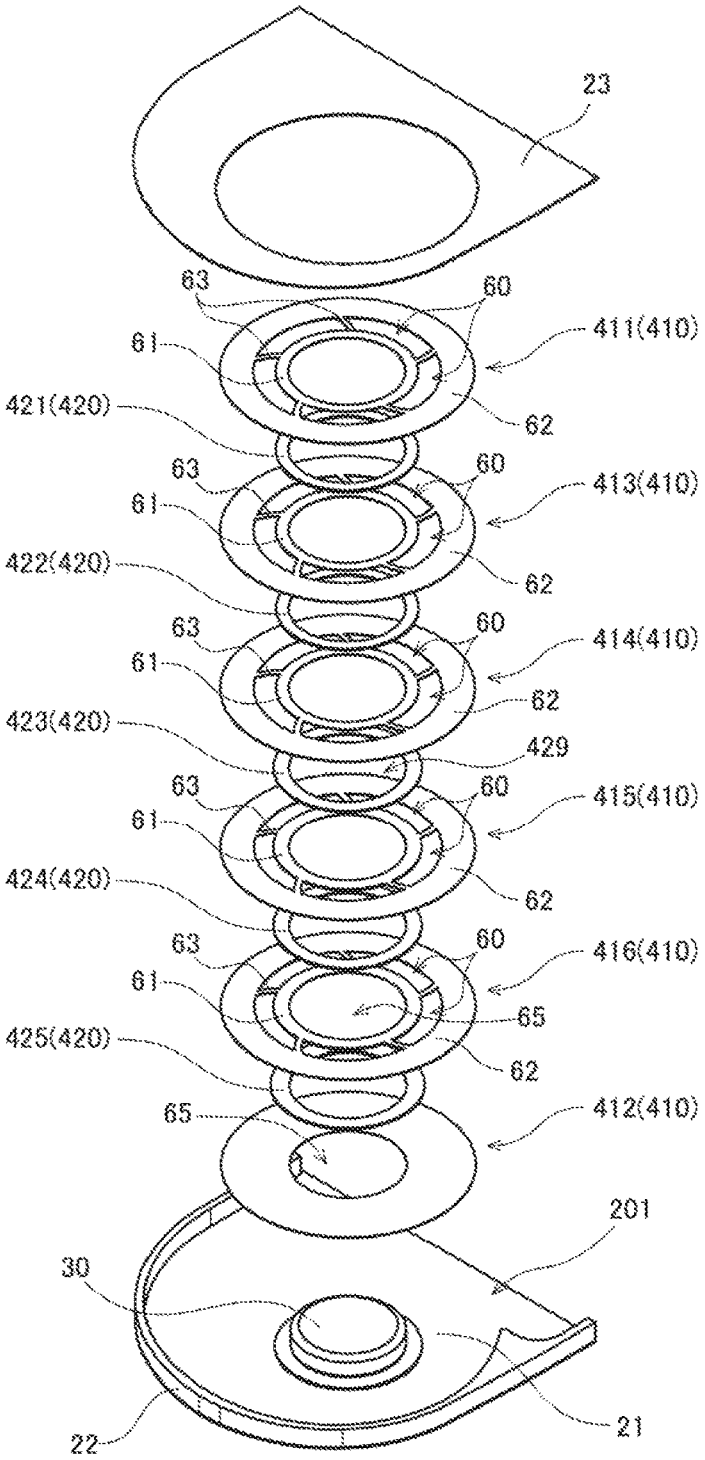
FIG. 4 is an exploded perspective view of the blower apparatus according to the first preferred embodiment.
Figure 5:
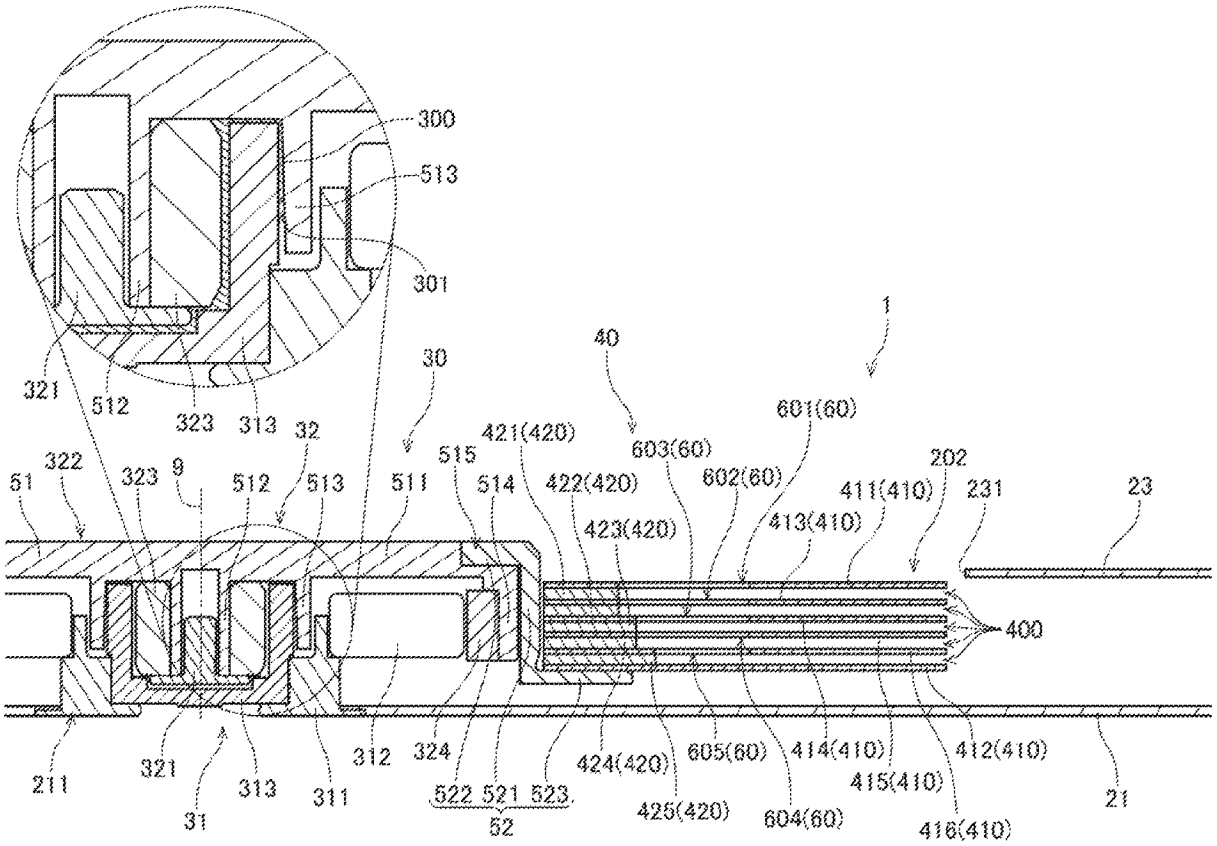
FIG. 5 is a partial sectional view of the blower apparatus according to the first preferred embodiment.

FIG. 1 is a perspective view of a blower apparatus 1 according to a first preferred embodiment of the present invention. FIG. 2 is a top view of the blower apparatus 1. FIG. 3 is a sectional view of the blower apparatus 1 taken along line A-A in FIG. 2. FIG. 4 is an exploded perspective view of the blower apparatus 1. FIG. 5 is a partial sectional view of the blower apparatus 1. The blower apparatus 1 is a centrifugal blower apparatus designed to generate an air flow traveling radially outward by rotating an air blowing portion 40. The blower apparatus 1 is, for example, installed in an electronic device, such as, for example, a personal computer, to cool an interior thereof. Note that the blower apparatus 1 according to a preferred embodiment of the present invention may alternatively be used for other purposes.

Referring to FIGS. 1 to 4, the blower apparatus 1 includes a housing 20, a motor portion 30, and the air blowing portion 40.

The housing 20 is a case arranged to house the motor portion 30 and the air blowing portion 40. The housing 20 includes a lower plate portion 21, a side wall portion 22, and an upper plate portion 23.

The lower plate portion 21 is arranged to define a bottom portion of the housing 20. The lower plate portion 21 is arranged to extend radially below the air blowing portion 40 to cover at least a portion of a lower side of the air blowing portion 40. In addition, the lower plate portion 21 is arranged to support the motor portion 30.

The side wall portion 22 is arranged to extend upward from the lower plate portion 21. The side wall portion 22 is arranged to cover a lateral side of the air blowing portion 40 between the lower plate portion 21 and the upper plate portion 23. In addition, the side wall portion 22 includes an air outlet 201 arranged to face in a radial direction at one circumferential position. In the present preferred embodiment, the lower plate portion 21 and the side wall portion 22 are defined integrally with each other. Note that the lower plate portion 21 and the side wall portion 22 may alternatively be defined by separate members.

The upper plate portion 23 is arranged to define a cover portion of the housing 20. The upper plate portion 23 is arranged to extend radially above the lower plate portion 21. In addition, the upper plate portion 23 includes an air inlet 202 arranged to pass therethrough in an axial direction. In other words, the upper plate portion 23 includes an inner edge portion 231 arranged to define the air inlet 202. The air inlet 202 is, for example, circular and is centered on a central axis 9 in a plan view.

The motor portion 30 is a driving portion arranged to rotate the air blowing portion 40. Referring to FIG. 5, the motor portion 30 includes a stationary portion 31 and a rotating portion 32. The stationary portion 31 is fixed to the lower plate portion 21. The stationary portion 31 is thus arranged to be stationary relative to the housing 20. The rotating portion 32 is supported to be rotatable about the central axis 9 with respect to the stationary portion 31.

The stationary portion 31 includes a stator fixing portion 311, a stator 312, and a bearing housing 313.

The stator fixing portion 311 is fitted in a fixing hole 211 defined in the lower plate portion 21. As a result, the stator fixing portion 311 is fixed to the lower plate portion 21. The stator fixing portion 311 is arranged to extend upward from the fixing hole 211 to assume a cylindrical shape with the central axis 9 as a center thereof. The stator 312 is fixed to an outer circumferential portion of an upper portion of the stator fixing portion 311.

The stator 312 is an armature arranged to generate magnetic flux in accordance with electric drive currents supplied from an external source. The stator 312 is arranged to annularly surround the central axis 9, which extends in a vertical direction. The stator 312 includes, for example, an annular stator core defined by laminated steel sheets, and conducting wires wound around the stator core.

The bearing housing 313 is a member being cylindrical and having a closed bottom. Specifically, the bearing housing 313 includes a disk-shaped bottom portion, and a cylindrical portion arranged to extend upward from the bottom portion. The bearing housing 313 is fixed to an inner circumferential surface of the stator fixing portion 311.

The rotating portion 32 includes a shaft 321, a hub 322, a bearing member 323, and a magnet 324.

The shaft 321 is a member arranged to extend along the central axis 9. The shaft 321 according to the present preferred embodiment includes a columnar portion arranged inside of a first cylindrical portion 512, which will be described below, and arranged to extend with the central axis 9 as a center thereof, and a disk-shaped portion arranged to extend radially from a lower end portion of the columnar portion.

The hub 322 is fixed to the shaft 321. The hub 322 is made up of a hub body member 51 and a flange member 52.

The hub body member 51 includes a first top plate portion 511, the first cylindrical portion 512, a second cylindrical portion 513, and a magnet holding portion 514.

The first top plate portion 511 is a disk-shaped portion arranged to extend radially with the central axis 9 as a center thereof. The first top plate portion 511 is arranged above the stator 312. The first top plate portion 511 has a recessed portion 515 recessed from an upper surface thereof at an outer edge portion thereof.

The first cylindrical portion 512 is arranged to extend downward from the first top plate portion 511 to assume a cylindrical shape with the central axis 9 as a center thereof. The columnar portion of the shaft 321 is housed in the first cylindrical portion 512. In addition, the shaft 321 is fixed to the first cylindrical portion 512.

The second cylindrical portion 513 is arranged to extend downward from the first top plate portion 511 to assume a cylindrical shape with the central axis 9 as a center thereof. The second cylindrical portion 513 is arranged to have an inside diameter greater than an outside diameter of the first cylindrical portion 512. In other words, the second cylindrical portion 513 is arranged radially outside of the first cylindrical portion 512.

The magnet holding portion 514 is arranged to extend downward from a radially outer end of the first top plate portion 511 to assume a cylindrical shape with the central axis 9 as a center thereof. The magnet holding portion 514 is arranged radially outside of the stator 312. The magnet 324 is fixed to an inner circumferential surface of the magnet holding portion 514.

The flange member 52 includes an outer wall portion 521, a second top plate portion 522, and a flat plate holding portion 523.

The outer wall portion 521 is a cylindrical portion arranged to extend in the vertical direction with the central axis 9 as a center thereof. The outer wall portion 521 is arranged to extend along an outer circumferential surface of the magnet holding portion 514 of the hub body member 51.

The second top plate portion 522 is arranged to extend radially inward from an upper end portion of the outer wall portion 521 to assume the shape of a circular ring. The second top plate portion 522 is arranged in the recessed portion 515, which is defined in the upper surface of the first top plate portion 511 of the hub body member 51. In addition, the upper surface of the first top plate portion 511 and an upper surface of the second top plate portion 522 are arranged at the same axial position.

The flat plate holding portion 523 is arranged to extend radially outward from a lower end portion of the outer wall portion 521. The flat plate holding portion 523 is arranged to hold the air blowing portion 40 on a radially outer side of the magnet holding portion 514 of the hub body member 51. In the present preferred embodiment, the air blowing portion 40 is mounted on an upper surface of the flat plate holding portion 523. The flat plate holding portion 523 is thus arranged to hold a plurality of flat plates 410 included in the air blowing portion 40.

The bearing member 323 is a cylindrical member arranged to extend in the vertical direction with the central axis 9 as a center thereof. The bearing member 323 is arranged to extend along an outer circumferential surface of the first cylindrical portion 512 of the hub body member 51. In addition, the bearing member 323 is fixed to the outer circumferential surface of the first cylindrical portion 512. The cylindrical portion of the bearing housing 313 is arranged radially outside of the bearing member 323 and radially inside of the second cylindrical portion 513 of the hub body member 51.

The magnet 324 is fixed to the inner circumferential surface of the magnet holding portion 514 of the hub body member 51. In addition, the magnet 324 is arranged radially outside of the stator 312. The magnet 324 according to the present preferred embodiment is in the shape of a circular ring. A radially inner surface of the magnet 324 is arranged radially opposite to the stator 312 with a slight gap therebetween. In addition, an inner circumferential surface of the magnet 324 includes north and south poles arranged to alternate with each other in a circumferential direction. Note that a plurality of magnets may be used in place of the magnet 324 in the shape of a circular ring. In the case where the plurality of magnets are used, the magnets are arranged in the circumferential direction such that north and south poles of the magnets alternate with each other.

As illustrated in an enlarged view in FIG. 5, a lubricating fluid 300 is arranged between the bearing housing 313 and a combination of the shaft 321, the bearing member 323, and the hub body member 51. A polyolester oil or a diester oil, for example, is used as the lubricating fluid 300. The shaft 321, the hub 322, and the bearing member 323 are supported to be rotatable with respect to the bearing housing 313 through the lubricating fluid 300. Thus, in the present preferred embodiment, the bearing housing 313, which is a component of the stationary portion 31, the combination of the shaft 321, the bearing member 323, and the hub body member 51, each of which is a component of the rotating portion 32, and the lubricating fluid 300 together define a fluid dynamic bearing.

A surface of the lubricating fluid 300 is defined in a seal portion 301, which is a gap between an outer circumferential surface of the bearing housing 313 and an inner circumferential surface of the second cylindrical portion 513 of the hub body member 51. In the seal portion 301, the distance between the outer circumferential surface of the bearing housing 313 and the inner circumferential surface of the second cylindrical portion 513 is arranged to increase with decreasing height. In other words, in the seal portion 301, the distance between the outer circumferential surface of the bearing housing 313 and the inner circumferential surface of the second cylindrical portion 513 is arranged to increase with increasing distance from the surface of the lubricating fluid 300. Since the radial width of the seal portion 301 thus increases with decreasing height, the lubricating fluid 300 is attracted upward in the vicinity of the surface of the lubricating fluid 300. This reduces the likelihood that the lubricating fluid 300 will leak out of the seal portion 301.

Use of the fluid dynamic bearing as a bearing mechanism that connects the stationary portion 31 and the rotating portion 32 allows the rotating portion 32 to rotate stably. Thus, the likelihood of an occurrence of an unusual sound from the motor portion 30 can be reduced.

Once electric drive currents are supplied to the stator 312 in the motor portion 30 as described above, magnetic flux is generated around the stator 312. Then, interaction between the magnetic flux of the stator 312 and magnetic flux of the magnet 324 produces a circumferential torque between the stationary portion 31 and the rotating portion 32, so that the rotating portion 32 is caused to rotate about the central axis 9 with respect to the stationary portion 31. The air blowing portion 40, which is held by the flat plate holding portion 523 of the rotating portion 32, is caused to rotate about the central axis 9 together with the rotating portion 32.

Referring to FIGS. 4 and 5, the air blowing portion 40 includes the plurality of flat plates 410 and a plurality of spacers 420. The flat plates 410 and the spacers 420 are arranged to alternate with each other in the axial direction. In addition, adjacent ones of the flat plates 410 and the spacers 420 are fixed to each other through, for example, adhesion.

Referring to FIGS. 4 and 5, in the present preferred embodiment, the flat plates 410 include a top flat plate 411, which is arranged at the highest position, a bottom flat plate 412, which is arranged at the lowest position, and four intermediate flat plates 413, 414, 415, and 416, which are arranged below the top flat plate 411 and above the bottom flat plate 412. That is, the number of flat plates 410 included in the air blowing portion 40 according to the present preferred embodiment is six. The flat plates 410 are arranged in the axial direction with an axial gap 400 defined between adjacent ones of the flat plates 410. The four intermediate flat plates 413 to 416 will be referred to as, from highest to lowest, a first intermediate flat plate 413, a second intermediate flat plate 414, a third intermediate flat plate 415, and a fourth intermediate flat plate 416.

Each flat plate 410 is made of, for example, a metal material, such as stainless steel, or a resin material. Each flat plate 410 may alternatively be made of, for example, paper. In this case, paper including a glass fiber, a metal wire, or the like in addition to plant fibers may be used. The flat plate 410 is able to achieve higher dimensional accuracy when the flat plate 410 is made of a metal material than when the flat plate 410 is made of a resin material.

Referring to FIGS. 1, 2, and 5, each of the top flat plate 411 and the intermediate flat plates 413 to 416 includes an inner annular portion 61, an outer annular portion 62, a plurality of ribs 63, and a plurality of air holes 60. In the present preferred embodiment, the number of ribs 63 and the number of air holes 60 included in each of the top flat plate 411 and the intermediate flat plates 413 to 416 are both five.

The inner annular portion 61 is an annular portion centered on the central axis 9. The inner annular portion 61 has a central hole 65 (see FIG. 4) arranged to pass therethrough in the vertical direction in a center thereof. The outer annular portion 62 is an annular portion arranged radially outside of the inner annular portion 61 with the central axis 9 as a center thereof. Each rib 63 is arranged to join the inner annular portion 61 and the outer annular portion 62 to each other. Each air hole 60 is arranged to be in communication with a space radially outside of the air blowing portion 40 through the axial gap(s) 400 adjacent to the flat plate 410 including the air hole 60 on the upper and/or lower sides of the flat plate 410. Each air hole 60 is arranged at a position overlapping with the air inlet 202 of the housing 20 when viewed in the axial direction.

The bottom flat plate 412 is an annular and plate-shaped member centered on the central axis 9. The bottom flat plate 412 has a central hole 65 arranged to pass therethrough in the vertical direction in a center thereof.

Referring to FIG. 4, each spacer 420 is a member in the shape of a circular ring. The spacers 420 are arranged between the flat plates 410 to secure the axial gaps 400 between the flat plates 410. Each spacer 420 has a central hole 429 arranged to pass therethrough in the vertical direction in a center thereof. The motor portion 30 is arranged in the central holes 65 of the flat plates 410 and the central holes 429 of the spacers 420.

Each spacer 420 is arranged at a position axially coinciding with the inner annular portion 61 of an upwardly adjacent one of the flat plates 410. Thus, the spacer 420 is arranged in a region in the corresponding axial gap 400, the region covering only a portion of the radial extent of the corresponding axial gap 400.

Once the motor portion 30 is driven, the air blowing portion 40 is caused to rotate together with the rotating portion 32. As a result, viscous drag of a surface of each flat plate 410 and a centrifugal force together generate an air flow traveling radially outward in the vicinity of the surface of the flat plate 410. Thus, an air flow traveling radially outward is generated in each of the axial gaps 400 between the flat plates 410. Thus, gas above the housing 20 is supplied to each axial gap 400 through the air inlet 202 of the housing 20 and the air holes 60 of the top flat plate 411 and the intermediate flat plates 413 to 416. Thus, a sufficient volume of gas is supplied to each axial gap 400, and the gas is discharged out of the blower apparatus 1 through the air outlet 201, which is defined in a side portion of the housing 20.

Here, each flat plate 410 is arranged to have an axial thickness of about 0.1 mm. Meanwhile, each axial gap 400 is arranged to have an axial dimension of about 0.3 mm. The axial dimension of the axial gap 400 is preferably in the range of 0.2 mm to 0.5 mm. An excessively large axial dimension of the axial gap 400 would lead to a separation between an air flow generated by a lower surface of the flat plate 410 on the upper side and an air flow generated by an upper surface of the flat plate 410 on the lower side during rotation of the air blowing portion 40. This separation could result in a failure to generate sufficient static pressure in the axial gap 400 to discharge a sufficient volume of air. Moreover, an excessively large axial dimension of the axial gap 400 would make it difficult to reduce the axial dimension of the blower apparatus 1. Accordingly, in this blower apparatus 1, the axial dimension of the axial gap 400 is arranged to be in the range of 0.2 mm to 0.5 mm. This arrangement allows the blower apparatus 1 to achieve a reduced thickness while allowing an increase in the static pressure in the axial gap 400 to discharge a sufficient volume of air.

Each of the top flat plate 411 and the four intermediate flat plates 413 to 416 includes the air holes 60. In each of the top flat plate 411 and the intermediate flat plates 413 to 416, the outer annular portion 62, which is arranged radially outside of the air holes 60, defines an air blowing region which generates an air flow in the vicinity of a surface thereof. Meanwhile, the bottom flat plate 412 includes no air hole 60. Therefore, in an upper surface of the bottom flat plate 412, an entire region radially outside of a portion of the bottom flat plate 412 which makes contact with the spacer 420 defines an air blowing region. In addition, in a lower surface of the bottom flat plate 412, an entire region radially outside of a portion of the bottom flat plate 412 which makes contact with the flat plate holding portion 523 defines an air blowing region. Notice that an air flow is generated by a lower surface of the flat plate holding portion 523 as well.

As described above, the bottom flat plate 412 has air blowing regions wider than the air blowing regions of the top flat plate 411 and the intermediate flat plates 413 to 416. Therefore, the axial gap 400 between the fourth intermediate flat plate 416 and the bottom flat plate 412 is able to have higher static pressure than any other axial gap 400.

Air flows passing downward through the air inlet 202 and the air holes 60 are drawn radially outward in each axial gap 400. Therefore, the air flows passing through the air holes 60 become weaker as they travel downward. In the present preferred embodiment, the bottom flat plate 412 is arranged to have an air blowing region wider than the air blowing regions of the top flat plate 411 and the intermediate flat plates 413 to 416 to cause a stronger air flow to be generated in the lowest one of the axial gaps 400 than in any other axial gap 400 to cause the air flows passing downward through the air holes 60 to be drawn toward the lowest axial gap 400. Thus, a sufficient volume of gas is supplied to the lowest axial gap 400 as well. As a result, the air blowing portion 40 achieves improved air blowing efficiency.

In a related-art blower apparatus that generates air flows by rotating an impeller including a plurality of blades, air flows generated by the impeller leak at upper and lower end portions of the impeller. This leakage of the air flows occurs regardless of the axial dimension of the blower apparatus. Therefore, as the blower apparatus is designed to be thinner, an effect of this leakage on the blower apparatus as a whole becomes greater, resulting in lower air blowing efficiency. Meanwhile, in the blower apparatus 1 according to the present preferred embodiment, the air flows are generated in the vicinity of the surfaces of the flat plates 410, and therefore, the air flows do not easily leak upward or downward. Therefore, even when the axial dimension of the air blowing portion 40, which generates the air flows, is reduced, a reduction in air blowing efficiency due to leakages of the air flows does not easily occur. That is, even when the blower apparatus 1 has a reduced thickness, a reduction in air blowing efficiency thereof does not easily occur.

In particular, in this blower apparatus 1, the top flat plate 411 and all the intermediate flat plates 413 to 416 include the air holes 60. Accordingly, all the axial gaps 400 are in axial communication with a space above the housing 20 through the air inlet 202 and the air holes 60. Thus, a sufficient volume of gas is supplied to all the axial gaps 400, and therefore, air blowing efficiency of the air blowing portion 40, in particular, is improved. Further, with the spacers 420 being arranged between the flat plates 410, each axial gap 400 can be adjusted to have a desired axial dimension. This allows desired air blowing performance to be easily achieved. Accordingly, the blower apparatus 1 is able to achieve improved air blowing efficiency even when the thickness of the blower apparatus 1 is reduced.

In addition, in a blower apparatus including an impeller, periodic noise occurs owing to the shape, number, arrangement, and so on of blades. However, this blower apparatus 1 is superior to a comparable blower apparatus including an impeller in terms of being silent, because the air flows are generated by the viscous drag of the surface of each flat plate 410 and the centrifugal force in the blower apparatus 1.

From the viewpoint of P-Q characteristics (i.e., flow rate-static pressure characteristics), the blower apparatus 1 including the flat plates 410 is able to produce a higher static pressure in a low flow rate region than the blower apparatus including the impeller. Therefore, when compared to the blower apparatus including the impeller, the blower apparatus 1 is suitable for use in a densely packed case, from which only a relatively small volume of air can be discharged. Examples of such cases include cases of electronic devices, such as, for example, personal computers.

Here, the spacers 420 will be referred to as, from highest to lowest, a first spacer 421, a second spacer 422, a third spacer 423, a fourth spacer 424, and a fifth spacer 425. Referring to FIG. 5, the fifth spacer 425, which is arranged at the lowest position, is arranged to have an outside diameter greater than an outside diameter of the first spacer 421, which is arranged at the highest position. In addition, each spacer 420 is arranged to have an outside diameter equal to or greater than an outside diameter of an upwardly adjacent one of the spacers 420.

Specifically, the second spacer 422 is arranged to have an outside diameter equal to the outside diameter of the first spacer 421, which is upwardly adjacent to the second spacer 422. The third spacer 423 is arranged to have an outside diameter greater than the outside diameter of the second spacer 422, which is upwardly adjacent to the third spacer 423. The fourth spacer 424 is arranged to have an outside diameter equal to the outside diameter of the third spacer 423, which is upwardly adjacent to the fourth spacer 424. In addition, the fifth spacer 425 is arranged to have an outside diameter greater than the outside diameter of the fourth spacer 424, which is upwardly adjacent to the fifth spacer 425. As described above, each spacer 420 is arranged to have an outside diameter equal to or greater than the outside diameter of the upwardly adjacent one of the spacers 420, so that the spacers 420 have a stable center of gravity. This leads to a stable center of gravity of the air blowing portion 40 as a whole. This allows the air blowing portion 40 to stably rotate, which leads to reduced noise.

As described above, the top flat plate 411 and the four intermediate flat plates 413 to 416, each of which includes the air holes 60, are arranged in series in the axial direction. Here, the air holes 60 of the top flat plate 411 will be referred to as first air holes 601. The air holes 60 of the first intermediate flat plate 413 will be referred to as second air holes 602. The air holes 60 of the second intermediate flat plate 414 will be referred to as third air holes 603. The air holes 60 of the third intermediate flat plate 415 will be referred to as fourth air holes 604. The air holes 60 of the fourth intermediate flat plate 416 will be referred to as fifth air holes 605. Thus, the first air holes 601, the second air holes 602, the third air holes 603, the fourth air holes 604, and the fifth air holes 605 are arranged in the order named from top to bottom.

The inner annular portion 61 of the fourth intermediate flat plate 416 is arranged to have an outside diameter greater than an outside diameter of the inner annular portion 61 of the top flat plate 411. That is, a distance between the central axis 9 and a radially inner end portion of each fifth air hole 605, which is arranged at the lowest position, is greater than a distance between the central axis 9 and a radially inner end portion of each first air hole 601, which is arranged at the highest position. Note that a distance between the central axis 9 and a radially inner end portion will be hereinafter referred to simply as "a radius of an inner end portion".

In addition, the inner annular portion 61 of each of the above flat plates 410 is arranged to have an outside diameter equal to or greater than the outside diameter of the inner annular portion 61 of an upwardly adjacent one of the flat plates 410. That is, a radius of an inner end portion of each air hole 60 is equal to or greater than a radius of an inner end portion of each air hole 60 of the upwardly adjacent one of the flat plates 410. Specifically, the radius of the inner end portion of each second air hole 602 is equal to the radius of the inner end portion of each first air hole 601. The radius of the inner end portion of each third air hole 603 is greater than the radius of the inner end portion of each second air hole 602. The radius of the inner end portion of each fourth air hole 604 is equal to the radius of the inner end portion of each third air hole 603. The radius of the inner end portion of each fifth air hole 605 is greater than the radius of the inner end portion of each fourth air hole 604.

Air flows passing downward through the air holes 601 to 605 are apt to flow radially outward as they travel downward, being influenced by an air flow traveling radially outward in each axial gap 400. Accordingly, an inner end of each air hole 60 is arranged at the same radial position as or radially outward of an inner end of each air hole 60 of the upwardly adjacent one of the flat plates 410, so that the gas can be efficiently supplied to the axial gaps 400 through the air holes 60. This results in improved air intake efficiency, which leads to improved air blowing efficiency of the blower apparatus 1.

In addition, in the present preferred embodiment, the outside diameter of each spacer 420 and the outside diameter of the inner annular portion 61 of the flat plate 410 that is in contact with the spacer 420 on the upper side are arranged to be the same. Specifically, the outside diameter of the first spacer 421 and the outside diameter of the inner annular portion 61 of the top flat plate 411 are arranged to be the same. The outside diameter of the second spacer 422 and the outside diameter of the inner annular portion 61 of the first intermediate flat plate 413 are arranged to be the same. The outside diameter of the third spacer 423 and the outside diameter of the inner annular portion 61 of the second intermediate flat plate 414 are arranged to be the same. The outside diameter of the fourth spacer 424 and the outside diameter of the inner annular portion 61 of the third intermediate flat plate 415 are arranged to be the same. The outside diameter of the fifth spacer 425 and the outside diameter of the inner annular portion 61 of the fourth intermediate flat plate 416 are arranged to be the same. This contributes to preventing a reduction in the opening area of each air hole 60 while maximizing areas of contact between the spacers 420 and the flat plates 410. That is, a stable center of gravity of the air blowing portion 40 as a whole can be achieved while a reduction in air intake efficiency is prevented or minimized.

Referring to FIG. 2, the air inlet 202 is centered on the central axis 9. That is, a center of the air inlet 202 coincides with the central axis 9. Meanwhile, the air blowing portion 40 is also centered on the central axis 9. Accordingly, differences in pressure do not easily occur at different circumferential positions in the air blowing portion 40. This contributes to reducing noise. It is assumed that the term "coincide" as used here includes not only "completely coincide" but also "substantially coincide".

2. Example Modifications

While a preferred embodiment of the present invention has been described above, it is to be understood that the present invention is not limited to the above-described preferred embodiment.

Figure 6:
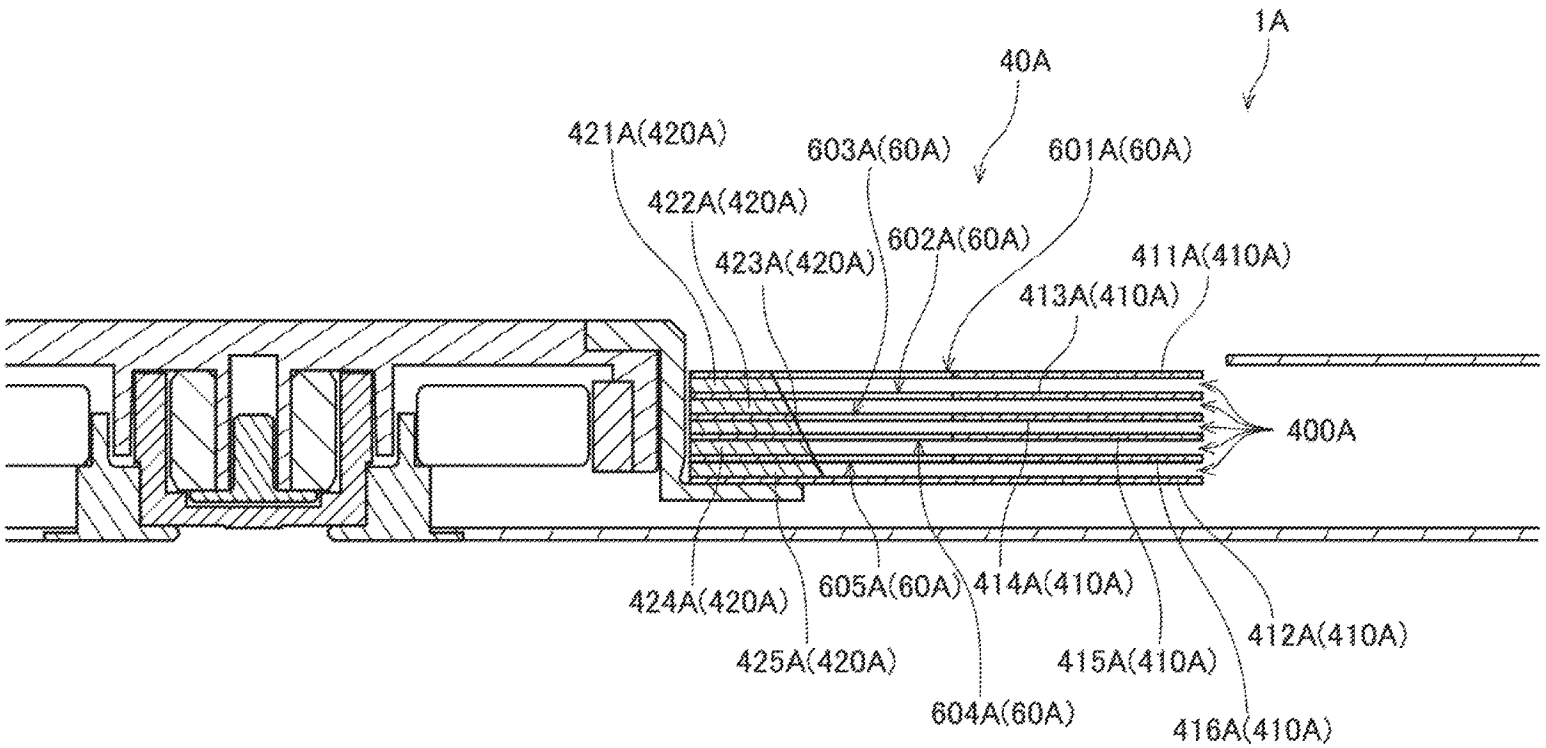
FIG. 6 is a partial sectional view of a blower apparatus according to a modification of the first preferred embodiment.

FIG. 6 is a partial sectional view of a blower apparatus 1A according to a modification of the above-described preferred embodiment. In the blower apparatus 1A according to the modification illustrated in FIG. 6, an air blowing portion 40A includes a plurality of flat plates 410A and a plurality of spacers 420A, similarly to the air blowing portion 40 according to the above-described preferred embodiment.

The flat plates 410A include a top flat plate 411A, which is arranged at the highest position, a bottom flat plate 412A, which is arranged at the lowest position, and four intermediate flat plates 413A, 414A, 415A, and 416A, which are arranged below the top flat plate 411A and above the bottom flat plate 412A. The four intermediate flat plates 413A to 416A will be referred to as, from highest to lowest, a first intermediate flat plate 413A, a second intermediate flat plate 414A, a third intermediate flat plate 415A, and a fourth intermediate flat plate 416A. The spacers 420A will be referred to as, from highest to lowest, a first spacer 421A, a second spacer 422A, a third spacer 423A, a fourth spacer 424A, and a fifth spacer 425A.

In this blower apparatus 1A, the fifth spacer 425A, which is arranged at the lowest position, is arranged to have an outside diameter greater than an outside diameter of the first spacer 421A, which is arranged at the highest position. In addition, each spacer 420A is arranged to have an outside diameter greater than an outside diameter of an upwardly adjacent one of the spacers 420A.

Specifically, the second spacer 422A is arranged to have an outside diameter greater than the outside diameter of the first spacer 421A, which is upwardly adjacent to the second spacer 422A. The third spacer 423A is arranged to have an outside diameter greater than the outside diameter of the second spacer 422A, which is upwardly adjacent to the third spacer 423A. The fourth spacer 424A is arranged to have an outside diameter greater than the outside diameter of the third spacer 423A, which is upwardly adjacent to the fourth spacer 424A. The fifth spacer 425A is arranged to have an outside diameter greater than the outside diameter of the fourth spacer 424A, which is upwardly adjacent to the fifth spacer 425A. The outside diameters of the spacers 420A are thus arranged to gradually increase with decreasing height, so that the spacers 420A have a stable center of gravity. This leads to a stable center of gravity of the air blowing portion 40A as a whole. This allows the air blowing portion 40A to stably rotate, which leads to reduced noise.

Each of the top flat plate 411A and the four intermediate flat plates 413A to 416A, which are arranged in series in the axial direction, includes air holes 60A. Here, the air holes 60A of the top flat plate 411A will be referred to as first air holes 601A. The air holes 60A of the first intermediate flat plate 413A will be referred to as second air holes 602A. The air holes 60A of the second intermediate flat plate 414A will be referred to as third air holes 603A. The air holes 60A of the third intermediate flat plate 415A will be referred to as fourth air holes 604A. The air holes 60A of the fourth intermediate flat plate 416A will be referred to as fifth air holes 605A. Thus, the first air holes 601A, the second air holes 602A, the third air holes 603A, the fourth air holes 604A, and the fifth air holes 605A are arranged in the order named from top to bottom.

A radius of an inner end portion (i.e., a distance between a central axis 9A and a radially inner end portion) of the fifth air hole 605A, which is arranged at the lowest position, is greater than a radius of an inner end portion of the first air hole 601A, which is arranged at the highest position. In addition, a radius of an inner end portion of each air hole 60A is greater than a radius of an inner end portion of each air hole 60A of an upwardly adjacent one of the flat plates 410A. Specifically, the radius of the inner end portion of each second air hole 602A is greater than the radius of the inner end portion of each first air hole 601A. The radius of the inner end portion of each third air hole 603A is greater than the radius of the inner end portion of each second air hole 602A. The radius of the inner end portion of each fourth air hole 604A is greater than the radius of the inner end portion of each third air hole 603A. The radius of the inner end portion of each fifth air hole 605A is greater than the radius of the inner end portion of each fourth air hole 604A.

Air flows passing downward through the air holes 601A to 605A are apt to flow radially outward as they travel downward, being influenced by an air flow traveling radially outward in each of axial gaps 400A. Accordingly, inner ends of the air holes 60A are arranged gradually more radially inward with increasing height, so that gas can be efficiently supplied to the axial gaps 400A through the air holes 60A. This results in improved air intake efficiency, which leads to improved air blowing efficiency of the blower apparatus 1A.

In addition, in this blower apparatus 1A, an outer end surface of each of the spacers 420A is angled radially outward with decreasing height. Thus, the outer end surface of each spacer 420A guides gas near the spacer 420A downward and radially outward. In addition, each of the top flat plate 411A and the intermediate flat plates 413A to 416A includes end surfaces each of which defines a radially inner end portion of a separate one of the air holes 60A, and each of the end surfaces is angled radially outward with decreasing height. Thus, each of the end surfaces of each of the flat plates 411A and 413A to 416A guides gas near the end surface downward and radially outward. Accordingly, gas can be more efficiently supplied to each axial gap 400A from air flows traveling downward through the air holes 60A. This results in further improved air intake efficiency, which leads to further improved air blowing efficiency of the blower apparatus 1A.

Figure 7:
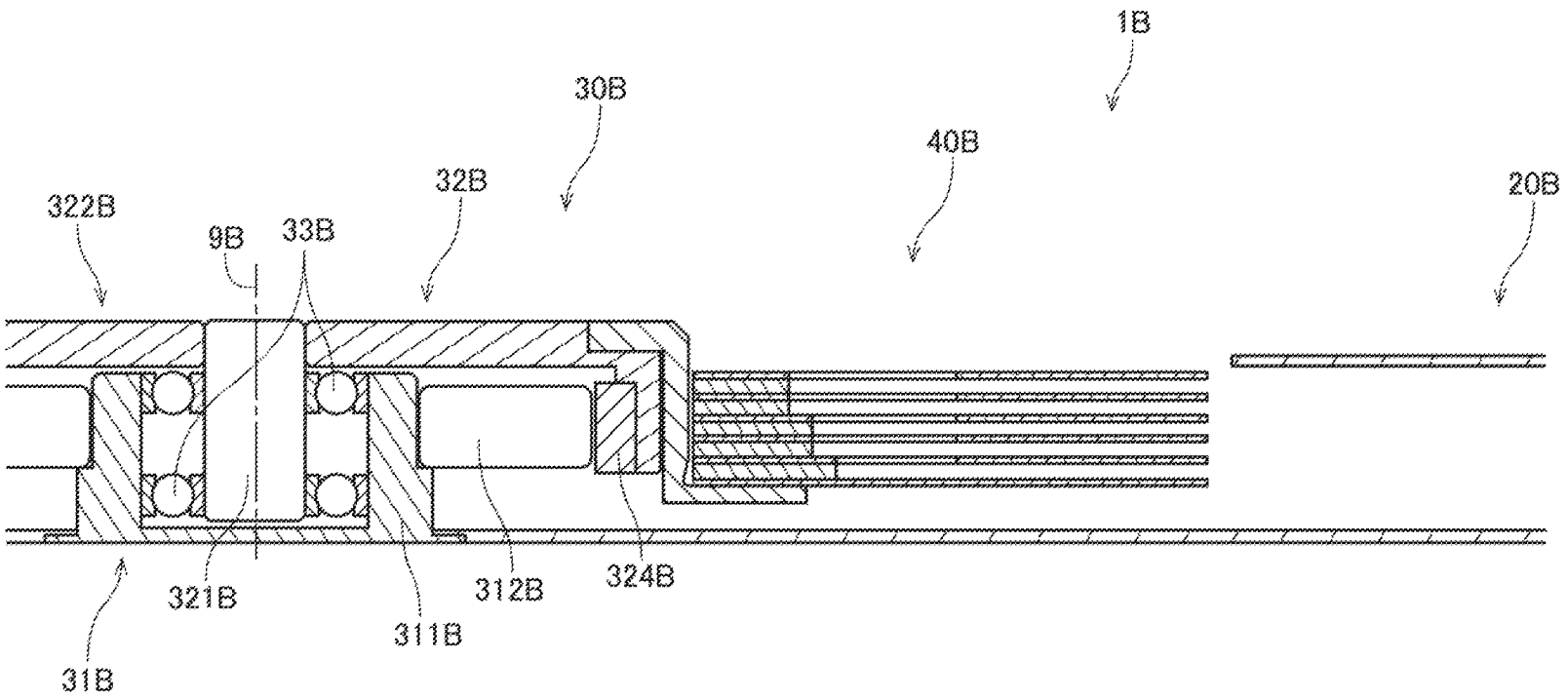
FIG. 7 is a partial sectional view of a blower apparatus according to a modification of the first preferred embodiment.

FIG. 7 is a partial sectional view of a blower apparatus 1B according to another modification of the above-described preferred embodiment. In the blower apparatus 1B according to the modification illustrated in FIG. 7, a motor portion 30B includes a stationary portion 31B, a rotating portion 32B, and two ball bearings 33B.

The stationary portion 31B includes a stator fixing portion 311B and a stator 312B. The stator fixing portion 311B is a member being cylindrical and having a closed bottom and fixed to a housing 20B. The stator 312B is an armature fixed to an outer circumferential surface of the stator fixing portion 311B.

The rotating portion 32B includes a shaft 321B, a hub 322B, and a magnet 324B. At least a lower end portion of the shaft 321B is arranged inside of the stator fixing portion 311B. In addition, an upper end portion of the shaft 321B is fixed to the hub 322B. The magnet 324B is fixed to the hub 322B. The magnet 324B is arranged radially opposite to the stator 312B.

Each ball bearing 33B is arranged to connect the rotating portion 32B to the stationary portion 31B such that the rotating portion 32B is rotatable with respect to the stationary portion 31B. Specifically, an outer race of each ball bearing 33B is fixed to an inner circumferential surface of the stator fixing portion 311B of the stationary portion 31B. In addition, an inner race of each ball bearing 33B is fixed to an outer circumferential surface of the shaft 321B of the rotating portion 32B. Further, a plurality of balls, each of which is a spherical rolling element, are arranged between the outer race and the inner race. As described above, instead of a fluid dynamic bearing, rolling-element bearings, such as, for example, ball bearings, may be used as a bearing structure of the motor portion 30B.

In the modification illustrated in FIG. 7, the motor portion 30B includes the two ball bearings 33B. The ball bearings 33B are arranged near an upper end and a lower end of an axial range over which the inner circumferential surface of the stator fixing portion 311B and the shaft 321B are opposed to each other. This contributes to preventing the shaft 321B from being inclined with respect to a central axis 9B.

Figure 8:
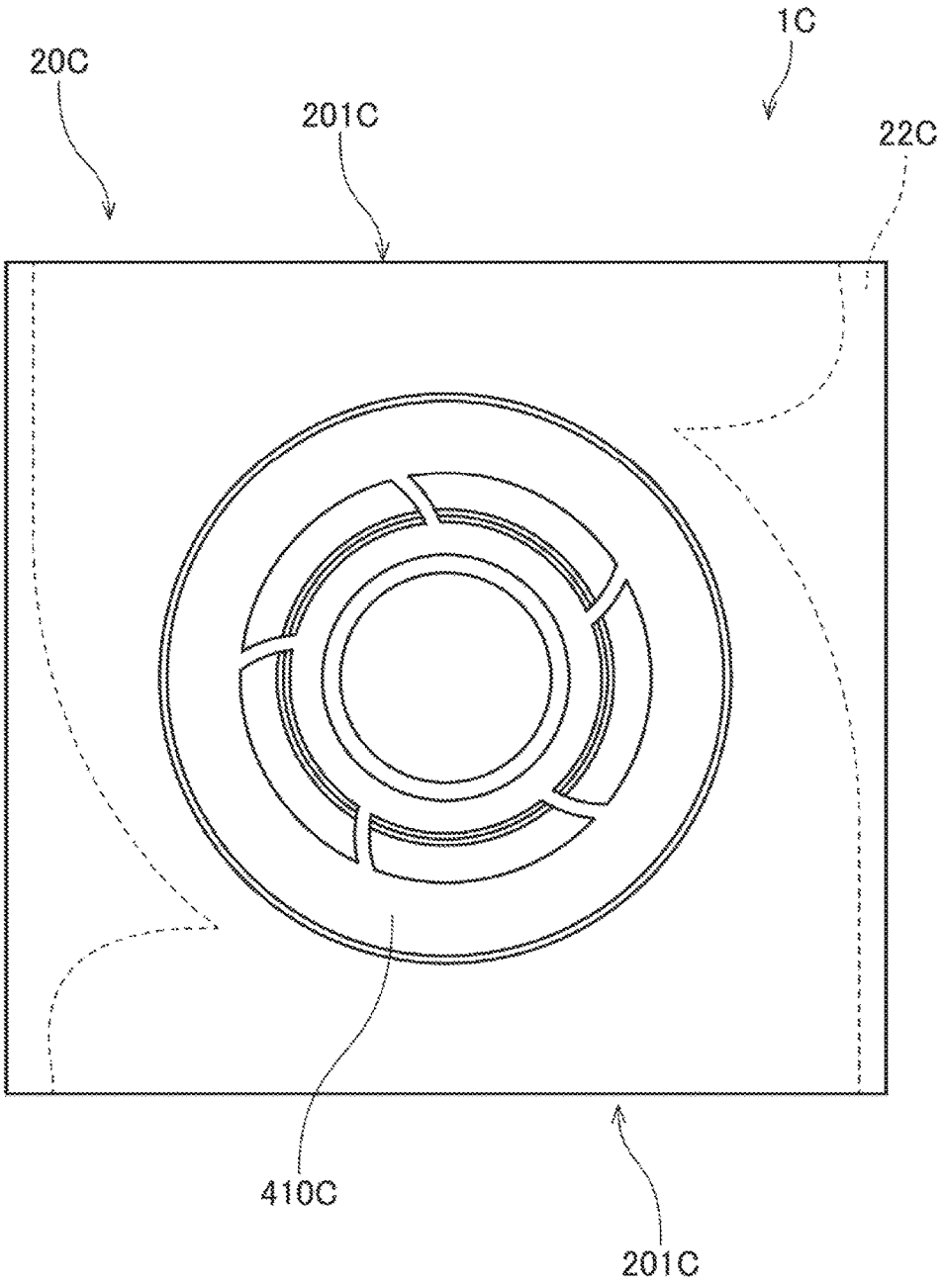
FIG. 8 is a top view of a blower apparatus according to a modification of the first preferred embodiment.

FIG. 8 is a top view of a blower apparatus 1C according to yet another modification of the above-described preferred embodiment. In the blower apparatus 1C according to the modification illustrated in FIG. 8, a housing 20C includes a plurality of air outlets 201C. Specifically, a side wall portion 22C includes the air outlets 201C, each of which is arranged to face in a radial direction, at a plurality of circumferential positions. The housing 20C includes tongue portions 203C, each of which is arranged near a separate one of the air outlets 201C. In addition, an air blowing portion 40C includes a plurality of flat plates 410C arranged in the axial direction with an axial gap defined between adjacent ones of the flat plates 410C.

In a centrifugal fan including an impeller, periodic noise occurs owing to the shape, number, arrangement, and so on of blades. In addition, such noise tends to easily occur around a tongue portion. Accordingly, when air is to be discharged in a plurality of directions, a deterioration in noise characteristics occurs because of an increased number of tongue portions. However, in this blower apparatus 1C, air flows traveling radially outward are generated by rotation of the flat plates 410C, and therefore, the blower apparatus 1C is able to achieve reduced periodic noise when compared to the centrifugal fan including the impeller. Therefore, the blower apparatus 1C, which is designed to discharge air in a plurality of directions, does not significantly deteriorate in noise characteristics due to the tongue portions 203C.

Note that, although the number of flat plates included in the air blowing portion is six in each of the above-described preferred embodiment and the modifications thereof, this is not essential to the present invention. The number of flat plates may alternatively be two, three, four, five, or more than six.

Also note that, although the hub is defined by two members, i.e., the hub body member and the flange member, in each of the above-described preferred embodiment and the modifications thereof, this is not essential to the present invention. The hub may alternatively be defined by a single member, or three or more members.

Also note that the detailed shape of any member may be different from the shape thereof as illustrated in the accompanying drawings of the present application. For example, the shape of any of the housing, the air blowing portion, and the motor portion may be different from that according to each of the above-described preferred embodiment and the modifications thereof. Also note that features of the above-described preferred embodiment and the modifications thereof may be combined appropriately as long as no conflict arises.

Preferred embodiments of the present invention are applicable to blower apparatuses.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower apparatus comprising:

an air blowing portion arranged to rotate about a central axis extending in a vertical direction;

a motor portion arranged to rotate the air blowing portion; and a housing arranged to house the air blowing portion and the motor portion; wherein the housing includes:

an air inlet arranged above the air blowing portion, and arranged to pass through a portion of the housing in an axial direction; and an air outlet arranged to face in a radial direction at at least one circumferential position radially outside of the air blowing portion;

the air blowing portion includes:

a plurality of flat plates arranged in the axial direction with an axial gap defined between adjacent ones of the flat plates; and a plurality of spacers each of which is arranged in a region in the axial gap between axially adjacent ones of the flat plates, the region covering a portion of a radial extent of the axial gap;

at least one of the flat plates includes an air hole arranged to pass therethrough in the axial direction; and each air hole is arranged to be in communication with a space radially outside of the air blowing portion through the axial gap.

2. The blower apparatus according to claim 1, wherein one of the spacers that is arranged at a lowest position is arranged to have an outside diameter greater than an outside diameter of one of the spacers that is arranged at a highest position; and each of the spacers is arranged to have an outside diameter equal to or greater than an outside diameter of an upwardly adjacent one of the spacers.

3. The blower apparatus according to claim 2, wherein each of the spacers is arranged to have an outside diameter greater than the outside diameter of the upwardly adjacent one of the spacers.

4. The blower apparatus according to claim 2, wherein each of the spacers includes an outer end surface angled radially outward with decreasing height.

5. The blower apparatus according to claim 1, wherein two or more of the flat plates which are arranged in series in the axial direction include the air holes;

a distance between the central axis and a radially inner end portion of the air hole that is arranged at a lowest position is arranged to be greater than a distance between the central axis and a radially inner end portion of the air hole that is arranged at a highest position; and a distance between the central axis and a radially inner end portion of each of the air holes is arranged to be equal to or greater than a distance between the central axis and the radially inner end portion of the air hole of an upwardly adjacent one of the flat plates.

6. The blower apparatus according to claim 5, wherein the distance between the central axis and the radially inner end portion of each of the air holes is arranged to be greater than the distance between the central axis and the radially inner end portion of the air hole of the upwardly adjacent one of the flat plates.

7. The blower apparatus according to claim 5, wherein each of the at least one of the flat plates includes an end surface defining the radially inner end portion of the air hole, the end surface being angled radially outward with decreasing height.

8. The blower apparatus according to claim 1, wherein a center of the air inlet is arranged to coincide with the central axis.

9. The blower apparatus according to claim 1, wherein the motor portion includes:

a stationary portion including an armature and a bearing housing; and a rotating portion including a shaft, a bearing member, and a magnet arranged radially opposite to the armature;

the bearing housing and a combination of the shaft and the bearing member are arranged to have a lubricating fluid therebetween;

the bearing housing and the rotating portion are arranged to together define a gap defining a seal portion therebetween, the seal portion having a surface of the lubricating fluid defined therein; and in the seal portion, a distance between the bearing housing and the rotating portion is arranged to increase with increasing distance from the surface of the lubricating fluid.

10. The blower apparatus according to claim 1, wherein the motor portion includes:

a stationary portion including an armature;

a rotating portion including a magnet arranged radially opposite to the armature; and a ball bearing arranged to connect the rotating portion to the stationary portion such that the rotating portion is rotatable with respect to the stationary portion.

11. The blower apparatus according to claim 1, wherein the housing includes a plurality of the air outlets at a plurality of circumferential positions.

* * * * *